US009709947B1

(12) United States Patent
Koyama et al.

(10) Patent No.: US 9,709,947 B1
(45) Date of Patent: Jul. 18, 2017

(54) IMAGE FORMING APPARATUS

(71) Applicant: FUJI XEROX CO., LTD., Tokyo (JP)

(72) Inventors: Takaharu Koyama, Kanagawa (JP); Takayuki Kikuchi, Kanagawa (JP); Masayuki Yamamiya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/226,174

(22) Filed: Aug. 2, 2016

(30) Foreign Application Priority Data

Feb. 26, 2016 (JP) ..... 2016-035362

(51) Int. Cl.
*G03G 15/00* (2006.01)
*G03G 21/16* (2006.01)

(52) U.S. Cl.
CPC ..... *G03G 21/1623* (2013.01); *G03G 21/1633* (2013.01)

(58) Field of Classification Search
CPC . G03G 21/16; G03G 21/1623; G03G 21/1633
See application file for complete search history.

(56) References Cited

U.S. PATENT DOCUMENTS

2015/0110516 A1* 4/2015 Mori ..... G03G 21/1633 399/91

FOREIGN PATENT DOCUMENTS

JP 2006-251754 A 9/2006
JP 4924928 B2 4/2012

* cited by examiner

*Primary Examiner* — Hoang Ngo
(74) *Attorney, Agent, or Firm* — Sughrue Mion, PLLC

(57) ABSTRACT

An image forming apparatus includes a containing member that is detachably disposed in an interior space of the housing and that contains a color material, an opening and closing member that opens and closes an opening of the housing by rotating about an axis, which is formed in a lower portion of the housing, when the containing member is replaced, and a cover member that includes surface portions, a first end attached to the housing, and a second end attached to the opening and closing member and that forms a color-material-receiving surface by covering a region between the housing and the opening and closing member from above when the opening and closing member opens the opening, the cover member being formed to be folded such that one of the surface portions and the other surface portions face one another when the opening and closing member closes the opening.

7 Claims, 6 Drawing Sheets

IMAGE FORMING APPARATUS

CROSS-REFERENCE TO RELATED APPLICATIONS

This application is based on and claims priority under 35 USC 119 from Japanese Patent Application No. 2016-035362 filed Feb. 26, 2016.

BACKGROUND

Technical Field

The present invention relates to an image forming apparatus.

SUMMARY

According to an aspect of the invention, there is provided an image forming apparatus including a containing member that is detachably disposed in an interior space of a housing and that contains a color material, an opening and closing member that opens and closes an opening of the housing by rotating about an axis, which is formed in a lower portion of the housing, when the containing member is replaced, and a cover member that includes plural surface portions, a first end, which is attached to the housing, and a second end, which is attached to the opening and closing member, and that forms a color-material-receiving surface by covering a region between the housing and the opening and closing member from above in a state where the opening and closing member opens the opening of the housing, the cover member being formed to be folded in such a manner that one of the surface portions and the other surface portions of the color-material-receiving surface face one another in a state where the opening and closing member closes the opening of the housing.

BRIEF DESCRIPTION OF THE DRAWINGS

An exemplary embodiment of the present invention will be described in detail based on the following figures, wherein.

DETAILED DESCRIPTION

Figure 1:
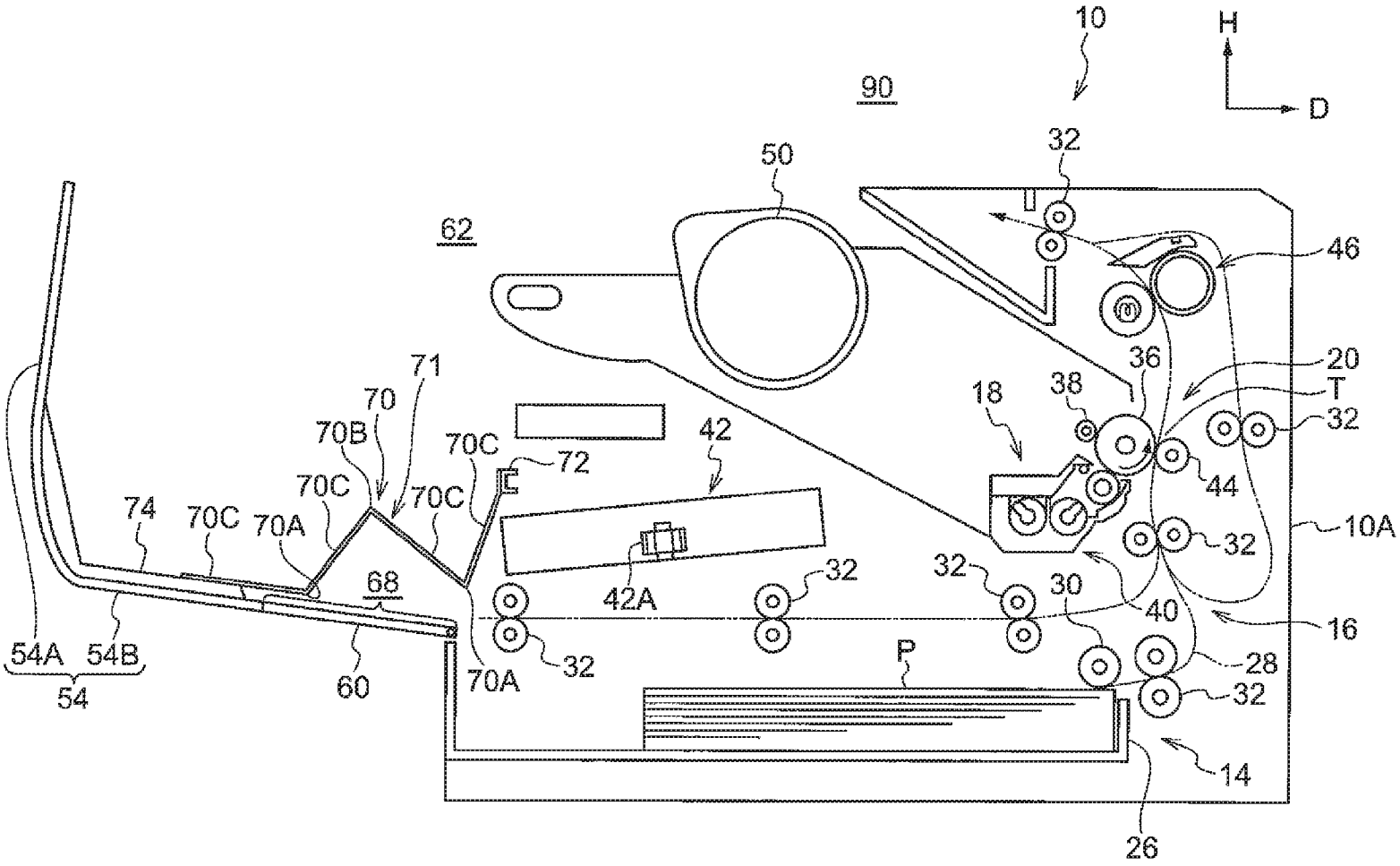
FIG. 1 is a schematic diagram illustrating an image forming apparatus according to an exemplary embodiment of the present invention when the image forming apparatus is viewed from a right side surface thereof.

An example of an image forming apparatus according to an exemplary embodiment of the present invention will be described with reference to FIG. 1 to FIG. 6B. Note that arrow H, arrow D, and arrow W that are illustrated in the drawings respectively indicate a top-bottom direction of the image forming apparatus (vertical direction), a depth direction of the image forming apparatus (horizontal direction), and a width direction of the image forming apparatus (horizontal direction). The depth direction of the image forming apparatus and the width direction of the image forming apparatus will hereinafter be referred to as an apparatus depth direction, and an apparatus width direction, respectively.

(Overall Configuration)

Figure 2:
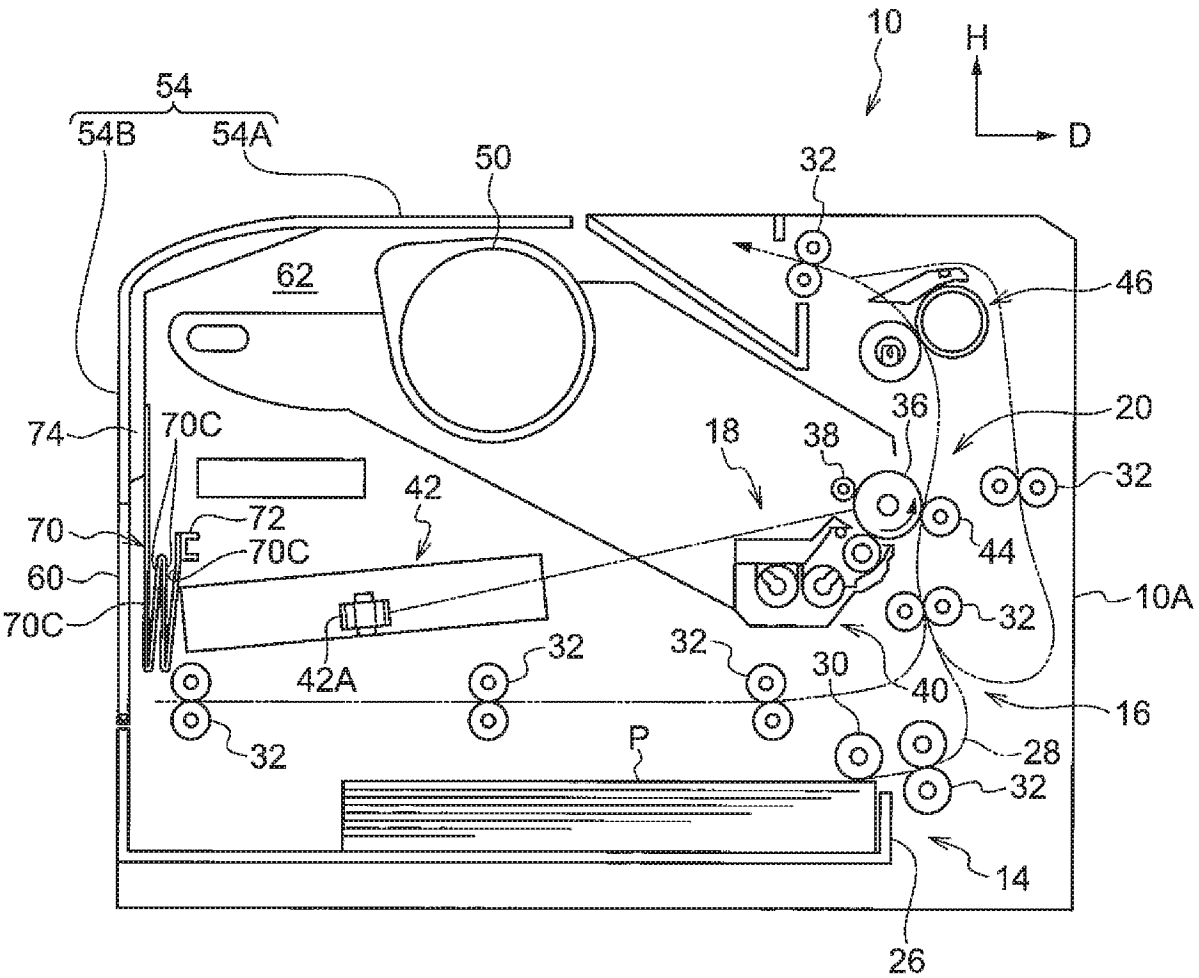
FIG. 2 is a schematic diagram illustrating the image forming apparatus according to the exemplary embodiment of the present invention when the image forming apparatus is viewed from the right side surface thereof.

As illustrated in FIG. 2, in an image forming apparatus 10 according to the present exemplary embodiment, an accommodating unit 14 in which sheets P, each of which serves as a recording medium, are accommodated, a transport unit 16 that transports the sheets P, which are accommodated in the accommodating unit 14, and an image forming unit 20 that performs image formation on the sheets P that are to be transported from the accommodating unit 14 by the transport unit 16 are disposed in this order from the lower side to the upper side in the top-bottom direction (direction of arrow H).

[Accommodating Unit]

The accommodating unit 14 includes a containing member 26 that is capable of being drawn out from a housing 10A of the image forming apparatus 10 in one direction in the apparatus depth direction (left direction in FIG. 1), and the sheets P are stacked in the containing member 26. In addition, the accommodating unit 14 includes a delivery roller 30 that sends out the sheets P, which are stacked in the containing member 26, to a transport path 28 that is included in the transport unit 16.

[Transport Unit]

The transport unit 16 includes plural transport rollers 32 that transport the sheets P along the transport path 28.

[Image Forming Unit]

The image forming unit 20 includes an image forming unit 18, which is an example of an image forming unit that is removable from a body of the image forming apparatus 10 and that forms a black image, a light scanning device 42 that radiates exposure light onto an image carrier 36 (described later), and a fixing device 46 that fixes, by using heat and pressure, a toner image formed of a toner T, which is an example of a color material, onto one of the sheets P.

The image forming unit 18 includes the image carrier 36, a charging roller 38 that charges a surface of the image carrier 36, and a developing device 40 that develops an electrostatic latent image, which is formed on the image carrier 36 as a result of the light scanning device 42 radiating the exposure light onto the image carrier 36, so as to visualize the electrostatic latent image as a toner image. In addition, the image forming unit 20 includes a transfer roller 44 that transfers the toner image, which is formed on the image carrier 36, onto one of the sheets P that is being transported.

The light scanning device 42 includes a polygon mirror 42A, which reflects a laser beam toward the image carrier 36 while rotating. Note that, when the polygon mirror 42A rotates, the light scanning device 42 generates noise.

[Others]

The image forming apparatus 10 includes a toner cartridge 50, which is an example of a containing member in which the toner T, which is black, is contained, and an opening and closing cover 54, which is an example of an opening and closing member that opens an opening 62 (see FIG. 1) of the housing 10A and that allows the toner cartridge 50 to be removed from an interior space 90, in which the toner cartridge 50 is accommodated, and to be replaced. In addition, the image forming apparatus 10 includes a manual feed tray 60 to which the sheets P may be manually supplied and a cover member 70 that covers, in a state where the opening and closing cover 54 opens the opening 62, a region 68 (see FIG. 1) between the opening and closing cover 54 and the housing 10A from above. A toner-receiving surface 71, which is an example of a color-material-receiving surface, is formed in a top surface of the cover member 70.

Note that details of the toner cartridge 50, the opening and closing cover 54, the manual feed tray 60, and the cover member 70 will be described later.

(Operation of Image Forming Apparatus)

In the image forming apparatus 10, an image is formed in the following manner.

First, the charging roller 38, to which a voltage has been applied, uniformly and negatively charges the surface of the image carrier 36 to a predetermined electric potential. Next, the light scanning device 42 radiates, on the basis of data input from the outside, the exposure light onto the charged surface of the image carrier 36 so as to form an electrostatic latent image.

As a result, an electrostatic latent image that corresponds to the data is formed on the surface of the image carrier 36. In addition, the developing device 40 develops the electrostatic latent image so as to visualize the electrostatic latent image as a toner image.

Then, one of the sheets P that has been sent out to the transport path 28 from the containing member 26 by the delivery roller 30 is sent out to a transfer position at which the image carrier 36 and the transfer roller 44 are in contact with each other. At the transfer position, at which the image carrier 36 and the transfer roller 44 are in contact with each other, the toner image on the surface of the image carrier 36 is transferred onto the sheet P as a result of the sheet P being transported while being nipped between the image carrier 36 and the transfer roller 44.

The toner image that has been transferred to the sheet P is fixed onto the sheet P by the fixing device 46. After that, the sheet P, to which the toner image has been fixed, is ejected to outside the housing 10A by the transport rollers 32.

(Configuration of Principal Portion)

The toner cartridge 50, the opening and closing cover 54, the manual feed tray 60, and the cover member 70 will now be described. Although the toner cartridge 50 will be described below as an example of a containing member that contains a color material, the containing member may be a waste-toner cartridge (not illustrated) that collects and contains an untransferred toner, which has not been transferred to one of the sheets P from the image carrier 36, or the like. In addition, an example of the color material may be a color material formed from an ink other than a toner.

[Toner Cartridge]

Figure 5:
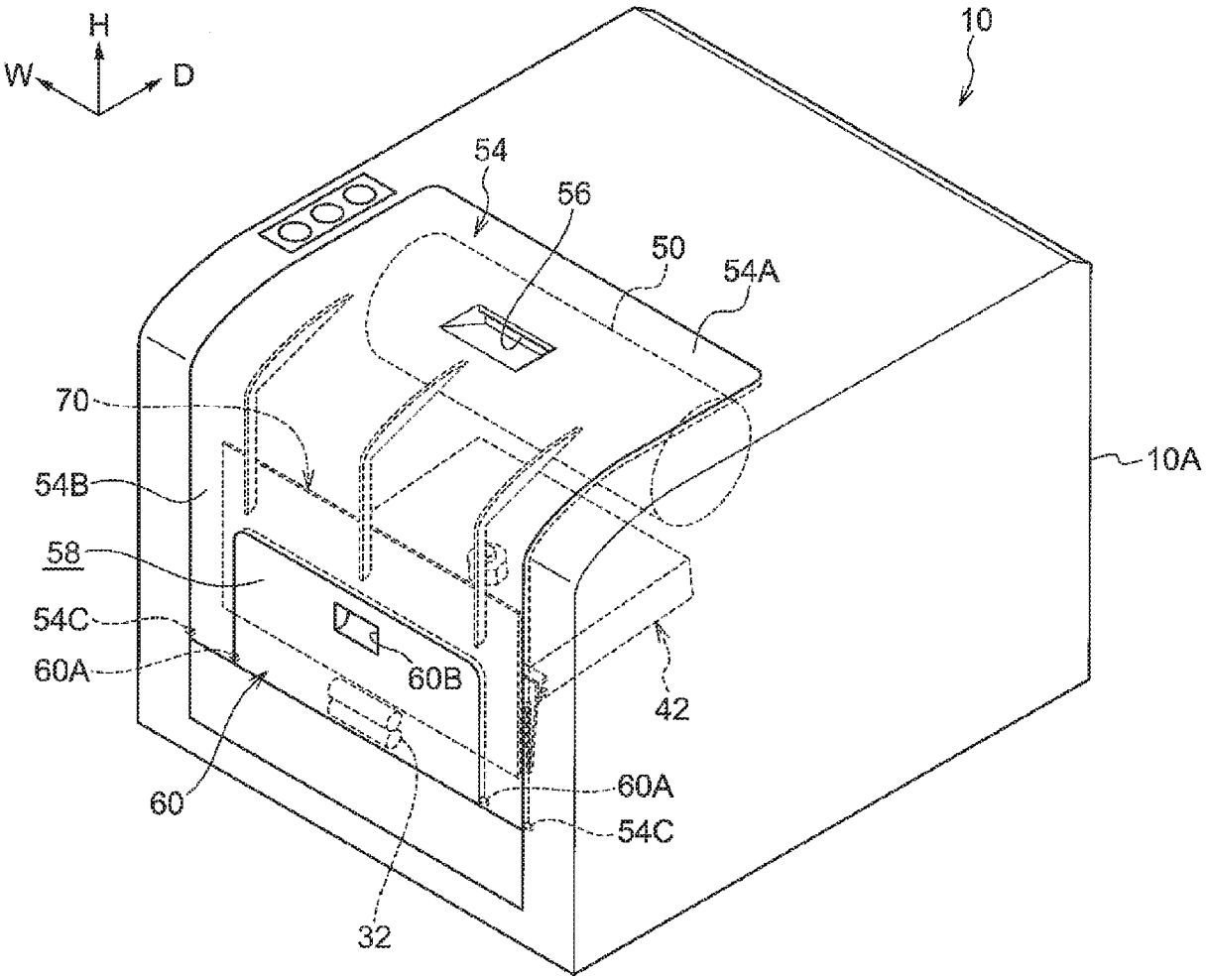
FIG. 5 is a perspective view of the image forming apparatus according to the exemplary embodiment of the present invention.

As illustrated in FIG. 2 and FIG. 5, the toner cartridge 50 is positioned, in the housing 10A, at the center in the apparatus depth direction and positioned on the upper side. The toner cartridge 50 is formed in a columnar shape extending in the apparatus width direction. The toner T contained in the toner cartridge 50 is supplied to the developing device 40, and the developing device 40 develops an electrostatic latent image by using the toner T as described above.

[Opening and Closing Cover]

When the opening and closing cover 54 is located at a closed position, which will be described later, the opening and closing cover 54 has an L shape when viewed in the apparatus width direction and includes an upper plate portion 54A having a plate surface oriented in the top-bottom direction and a side plate portion 54B having a plate surface oriented in the apparatus depth direction. A pair of shaft portions 54C (see FIG. 5) that extend in the apparatus width direction are formed in a lower portion of the side plate portion 54B. A holding portion 56 that may be held by a user is formed in the upper plate portion 54A. As illustrated in FIG. 2, in a state where the opening and closing cover 54 is located at the closed position, the toner cartridge 50 is positioned below the upper plate portion 54A.

With this configuration, the opening and closing cover 54 rotates about the shaft portions 54C as a result of a user operating the opening and closing cover 54 by holding the holding portion 56. The opening and closing cover 54 is formed to be located at the closed position (see FIG. 2 and FIG. 5) at which the opening and closing cover 54 closes the opening 62, which has an L shape when viewed in the apparatus width direction, or at an open position (see FIG. 1 and FIG. 3) at which the opening and closing cover 54 opens the opening 62 of the housing 10A. Note that the opening and closing cover 54 is caused to stop at the open position or the closed position by a stopper (not illustrated). As illustrated in FIG. 1, in a state where the opening and closing cover 54 is located at the open position, a region above the toner cartridge 50 is open.

As illustrated in FIG. 5, a cutout portion 58 having a rectangular shape whose lower portion is open is formed in the side plate portion 54B. The manual feed tray 60 is disposed in the cutout portion 58.

[Manual Feed Tray]

As illustrated in FIG. 2 and FIG. 5, when the manual feed tray 60 is located at a closed position, which will be described later, the manual feed tray 60 has a rectangular shape extending in the apparatus width direction when viewed in the apparatus depth direction and is disposed in the cutout portion 58 of the side plate portion 54B as described above.

A pair of shaft portions 60A that extend in the apparatus width direction are formed in a lower portion of the manual feed tray 60. A holding portion 60B, which may be held by a user, and a to-be-engaged portion (not illustrated), which engages with an engagement portion that is formed in the cutout portion 58 of the opening and closing cover 54, are formed in an upper portion of the manual feed tray 60. As a result of the engagement portion and the to-be-engaged portion engaging with each other, the manual feed tray 60 is maintained at the closed position at which the manual feed tray 60 closes the cutout portion 58.

Figure 4:
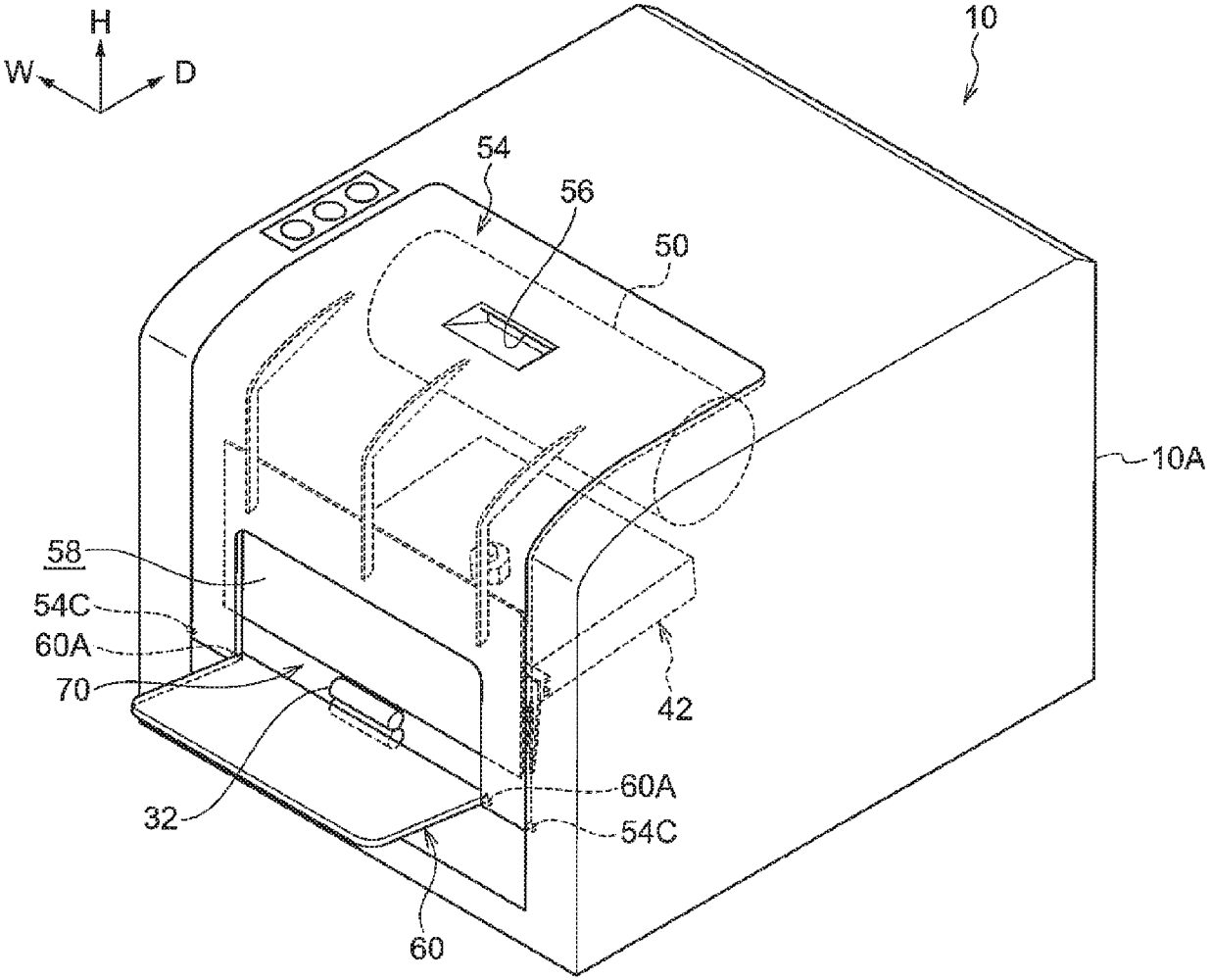
FIG. 4 is a perspective view of the image forming apparatus according to the exemplary embodiment of the present invention.

With this configuration, as a result of a user operating the manual feed tray 60 by holding the holding portion 60B, the above-mentioned engagement of the engagement portion and the to-be-engaged portion is released, and the manual feed tray 60 rotates about the shaft portions 60A. This causes the manual feed tray 60 to open the cutout portion 58, and the manual feed tray 60 is formed to be located at an open position (see FIG. 4) at which the sheets P may be manually supplied to the manual feed tray 60 from outside the housing 10A or at the closed position (see FIG. 5). More specifically, as illustrated in FIG. 4, in a state where the manual feed tray 60 is located at the open position, the transport rollers 32 are exposed to the outside, and the sheets P may be manually supplied to the manual feed tray 60 from the outside.

In a state where the opening and closing cover 54 and the manual feed tray 60 are located at their closed positions, when the opening and closing cover 54 is operated so as to move to the open position, the engagement of the engagement portion and the to-be-engaged portion is maintained, and the manual feed tray 60 is maintained at the closed position at which the manual feed tray 60 closes the cutout portion 58.

As illustrated in FIG. 1, in a state where the opening and closing cover 54 is located at the open position, the manual feed tray 60 is positioned in the region 68 between the opening and closing cover 54 and the housing 10A. However, in this state, the cover member 70, which will be described below, covers a region above the manual feed tray 60, and thus, it is difficult to manually supply the sheets P to the manual feed tray 60 from the outside.

[Cover Member]

The cover member 70 is formed of a piece of black nonwoven fabric. As illustrated in FIG. 1 and FIG. 2, a first end of the cover member 70 is attached to a frame member 72, which is attached to the interior of the housing 10A, and a second end of the cover member 70 is attached to a top surface of a rib 74, which is formed on an inner surface of the side plate portion 54B of the opening and closing cover 54. Note that the second end of the cover member 70 may be directly attached to the inner surface of the side plate portion 54B of the opening and closing cover 54.

Figure 3:
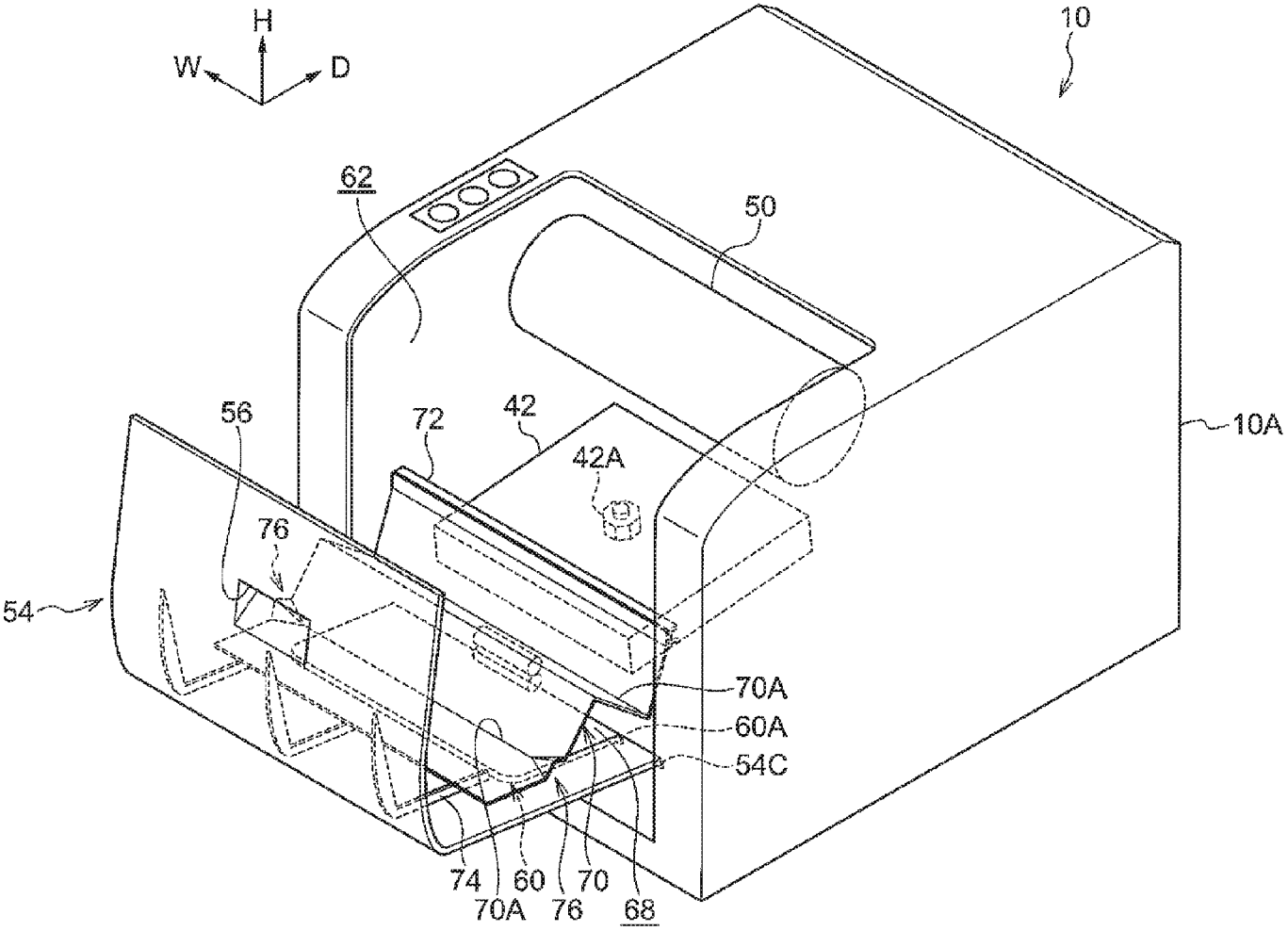
FIG. 3 is a perspective view of the image forming apparatus according to the exemplary embodiment of the present invention.

As illustrated in FIG. 1 and FIG. 3, in a state where the opening and closing cover 54 is located at the open position, the cover member 70 covers the region 68 from above. In other words, the cover member 70 covers the manual feed tray 60 from above. That is to say, the length of the cover member 70 in the apparatus width direction is set to be longer than the length of the manual feed tray 60 in the apparatus width direction.

In addition, the cover member 70 includes two valley-folded portions 70A each of which is to be folded in such a manner that a region above the valley-folded portion 70A is open, a mountain-folded portion 70B that is to be folded in such a manner that a region below the mountain-folded portion 70B is open, and flat surface portions 70C that are arranged at both sides of each of the valley-folded portions 70A and the mountain-folded portion 70B, each of the flat surface portions 70C being an example of a surface portion. In a state where the opening and closing cover 54 is located at the open position and where the cover member 70 covers the manual feed tray 60 from above, the flat surface portions 70C are inclined in such a manner that the toner T that has been deposited on the flat surface portions 70C moves toward the valley-folded portions 70A. Note that each of the surface portions may be a flat surface or may be a curved surface.

Figure 6A:
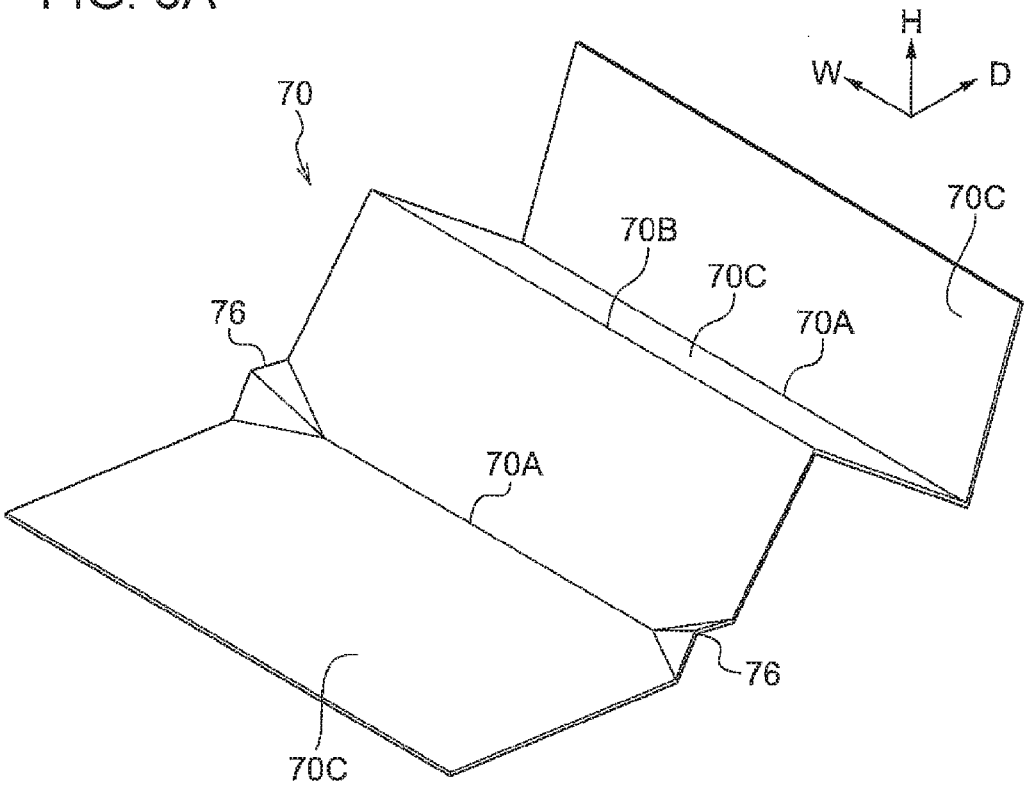
FIGS. 6A and 6B are perspective views each illustrating a cover member included in the image forming apparatus according to the exemplary embodiment of the present invention.

As illustrated in FIG. 3 and FIG. 6A, in a state where the cover member 70 covers the manual feed tray 60 from above, weirs 76 are formed at the ends of one of the valley-folded portions 70A in a direction in which a folding line of the valley-folded portion 70A extends, and the weirs 76 interrupt the toner T, which has collected in the valley-folded portion 70A, in such a manner that the toner T will not be spilled from the ends of the valley-folded portion 70A. The weirs 76 are formed by folding each of the end portions of the valley-folded portion 70A into a triangular shape.

Figure 6B:
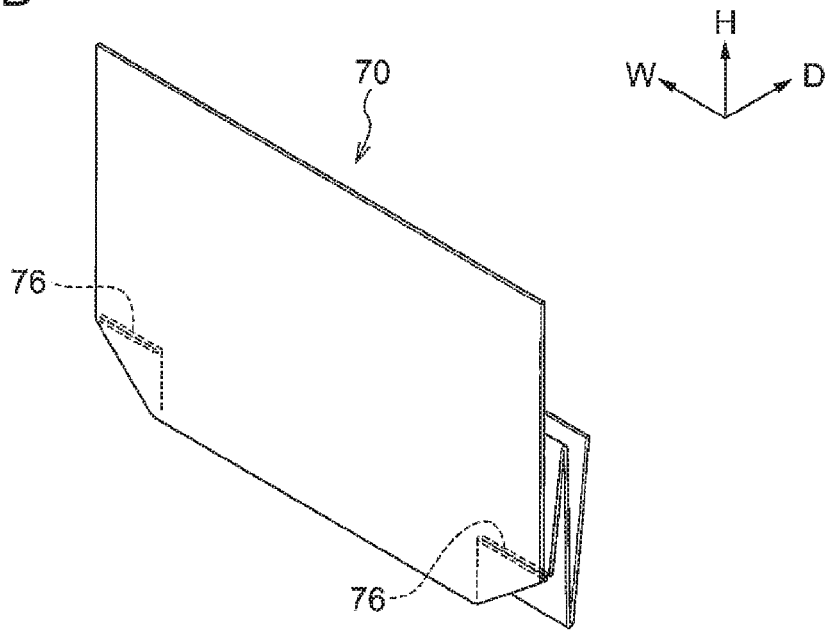

As illustrated in FIG. 2, in a state where the opening and closing cover 54 is located at the closed position, the cover member 70 is folded in the housing 10A in such a manner that one of the flat surface portions 70C and another one of the flat surface portions 70C face each other with one of the valley-folded portions 70A interposed therebetween and that a region above these flat surface portions 70C and the valley-folded portion 70A is open. As illustrated in FIG. 5, when viewed from the opening and closing cover 54, portions of the folded cover member 70, the portions being folded on top of one another, are positioned so as to be superposed with the light scanning device 42. Note that, as illustrated in FIG. 6B, when the cover member 70 is folded, the weirs 76 are also folded.

(Configuration and Operation of Principal Portion)

When causing the image forming apparatus 10 to operate so as to form a toner image on one of the sheets P, as illustrated in FIG. 2, the opening and closing cover 54 is located at the closed position, and the cover member 70 is folded in the housing 10A. After causing the image forming apparatus 10 to operate, the light scanning device 42, which includes the polygon mirror 42A rotating in the light scanning device 42, causes the exposure light to scan the surface of the image carrier 36, the surface having been charged, so as to form an electrostatic latent image. Here, the light scanning device 42 generates noise as a result of a driving force that causes the polygon mirror 42A to rotate being generated.

In contrast, when causing the image forming apparatus 10 not to operate so as to replace the toner cartridge 50, as illustrated in FIG. 1 and FIG. 3, a user causes the opening and closing cover 54 to be located at the open position by rotating the opening and closing cover 54 and opens the opening 62. As a result, the cover member 70, which has been folded in the housing 10A, is unfolded so as to cover the manual feed tray 60 from above.

Then, the user removes the toner cartridge 50 from the housing 10A. In this case, a portion of the toner T that has fallen off from the toner cartridge 50 is deposited onto the toner-receiving surface 71 of the cover member 70. After the replacement of the toner cartridge 50 has been completed, the user causes the opening and closing cover 54, which has been located at the open position, to be located at the closed position by rotating the opening and closing cover 54. As a result, the cover member 70 is folded in such a manner that a pair of the flat surface portions 70C face each other with one of the valley-folded portions 70A interposed therebetween and that another pair of the flat surface portions 70C face each other with the other one of the valley-folded portions 70A interposed therebetween such that the regions above the flat surface portions 70C and the valley-folded portions 70A are open.

Note that although a specific exemplary embodiment of the present invention has been described in detail, the present invention is not limited to the exemplary embodiment, and it is obvious to those skilled in the art that the present invention may employ other various exemplary embodiments within the scope of the present invention. For example, although the toner cartridge 50 that contains the toner T, which is used in an image forming operation, has been described as an example of a containing member in the above-described exemplary embodiment, the containing member may be a containing member that contains the toner T discharged from the image forming unit 18 or may be a containing member that contains an ink or the like that is used for forming an image.

Although, in the above-described exemplary embodiment, the cover member 70 has a W shape when viewed in the apparatus width direction in a state where the cover member 70 covers the region 68 from above, the cover member 70 may have a valley-folded portion while a region above the valley-folded portion is open and may be formed in an L shape or the like.

Although the cover member 70 includes two valley-folded portions 70A and one mountain-folded portion 70B in the above-described exemplary embodiment, the cover member 70 may include plural valley-folded portions 70A and plural mountain-folded portions 70B.

Although the cover member 70 is formed of a piece of nonwoven fabric in the above-described exemplary embodiment, the cover member 70 may be formed in such a manner as to include a piece of nonwoven fabric.

Although, in the above-described exemplary embodiment, the manual feed tray 60 is positioned in the region 68 in a state where the opening and closing cover 54 is located at the open position, the manual feed tray 60 is not particularly limited to being positioned in the region 68. In this case, as a result of the cover member 70 covering the region 68 from above, the probability that the toner T that has fallen off from the toner cartridge 50 will be deposited onto a region outside the housing 10A and a region inside the housing 10A by passing through the region 68 is reduced.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a containing member that is detachably disposed in an interior space of a housing and that contains a color material;

an opening and closing member that opens and closes an opening of the housing by rotating about an axis, which is formed in a lower portion of the housing, when the containing member is replaced; and a cover member that includes a plurality of surface portions, a first end, which is attached to the housing, and a second end, which is attached to the opening and closing member, and that forms a color-material-receiving surface by covering a region between the housing and the opening and closing member from above in a state where the opening and closing member opens the opening of the housing, the cover member being formed to be folded in such a manner that one of the surface portions and the other surface portions of the color-material-receiving surface face one another in a state where the opening and closing member closes the opening of the housing.

2. The image forming apparatus according to claim 1, wherein a valley-folded portion that is to be folded in such a manner that a region above the valley-folded portion is open, a mountain-folded portion that is to be folded in such a manner that a region below the mountain-folded portion is open, and the surface portions that are arranged at both sides of the valley-folded portion and the mountain-folded portion are formed in the cover member.

3. The image forming apparatus according to claim 2, wherein, in a state where the cover member covers the region between the housing and the opening and closing member from above, the surface portions are inclined in such a manner that the color material that has been deposited on the surface portions moves toward the valley-folded portion.

4. The image forming apparatus according to claim 2, wherein weirs are formed at both ends of the valley-folded portion in a direction in which a folding line of the valley-folded portion extends, the weirs being formed to prevent the color material collected in the valley-folded portion from being spilled from the ends of the valley-folded portion.

5. The image forming apparatus according to claim 1, further comprising:

an image forming unit that forms an image by using the color material, wherein the image forming unit includes an image carrier, a light scanning device that forms an electrostatic latent image by causing light to scan the image carrier, and a developing member that develops the electrostatic latent image by using the color material, and wherein, in a state where the opening and closing member closes the opening of the housing, the cover member is folded in the housing and is disposed at a position that is superposed with the light scanning device when viewed from the opening and closing member.

6. The image forming apparatus according to claim 1, wherein the cover member is black.

7. The image forming apparatus according to claim 1, wherein the cover member is formed in such a manner as to include a piece of nonwoven fabric.

* * * * *